US006264755B1

(12) United States Patent
Georgiou

(10) Patent No.: US 6,264,755 B1
(45) Date of Patent: Jul. 24, 2001

(54) METHOD OF CLEANING A HOOK/LOOP MATERIAL

(76) Inventor: Melissa Alden Georgiou, 21681 Pebble Beach Ct., Leonardtown, MD (US) 20650

( * ) Notice: Subject to any disclaimer, the term of this patent is extended or adjusted under 35 U.S.C. 154(b) by 0 days.

(21) Appl. No.: 09/522,346

(22) Filed: Mar. 9, 2000

(51) Int. Cl.[7] ..... B08B 7/00
(52) U.S. Cl. ..... 134/6; 15/142
(58) Field of Search ..... 15/104.001, 142; 134/6

(56) References Cited

U.S. PATENT DOCUMENTS 1,183,528 * 5/1916 Bongiovanni ..... 15/142
1,280,821 * 10/1918 O'Leary ..... 15/142 X
1,381,973 * 6/1921 Davis ..... 15/142 X
1,425,923 * 8/1922 Weyhrauch ..... 15/142
1,463,809 * 8/1923 Fritz ..... 15/142
2,084,603 * 6/1937 True ..... 15/142
2,564,721 * 8/1951 Raya ..... 15/142
3,170,182 * 2/1965 Burian ..... 15/142
4,627,126 * 12/1986 Nichols ..... 15/104.001 X
5,922,139 * 7/1999 Gilbert ..... 15/142 X

FOREIGN PATENT DOCUMENTS

2251783 * 7/1992 (GB) ..... 15/142

* cited by examiner

*Primary Examiner*—Mark Spisich

(57) ABSTRACT

The Cleaner is a comb-like instrument designed to clean debris from VELCRO. Its prongs are sized and spaced to fit between the rows of hooks on different sizes of VELCRO. A handle, approximately perpendicular to the prongs, is used to slide the prongs between the VELCRO's rows and under debris. A vertical motion will lift up the debris and restore the VELCRO's effectiveness and appearance.

1 Claim, 1 Drawing Sheet

METHOD OF CLEANING A HOOK/LOOP MATERIAL

STATEMENT REGARDING FEDERALLY SPONSORED RESEARCH OR DEVELOPMENT

Non Applicable

CROSS-REFERENCE TO RELATED APPLICATIONS

Non Applicable

REFERENCE TO A MICROFICHE APPENDIX

Non Applicable

BACKGROUND OF THE INVENTION

Figure 1:
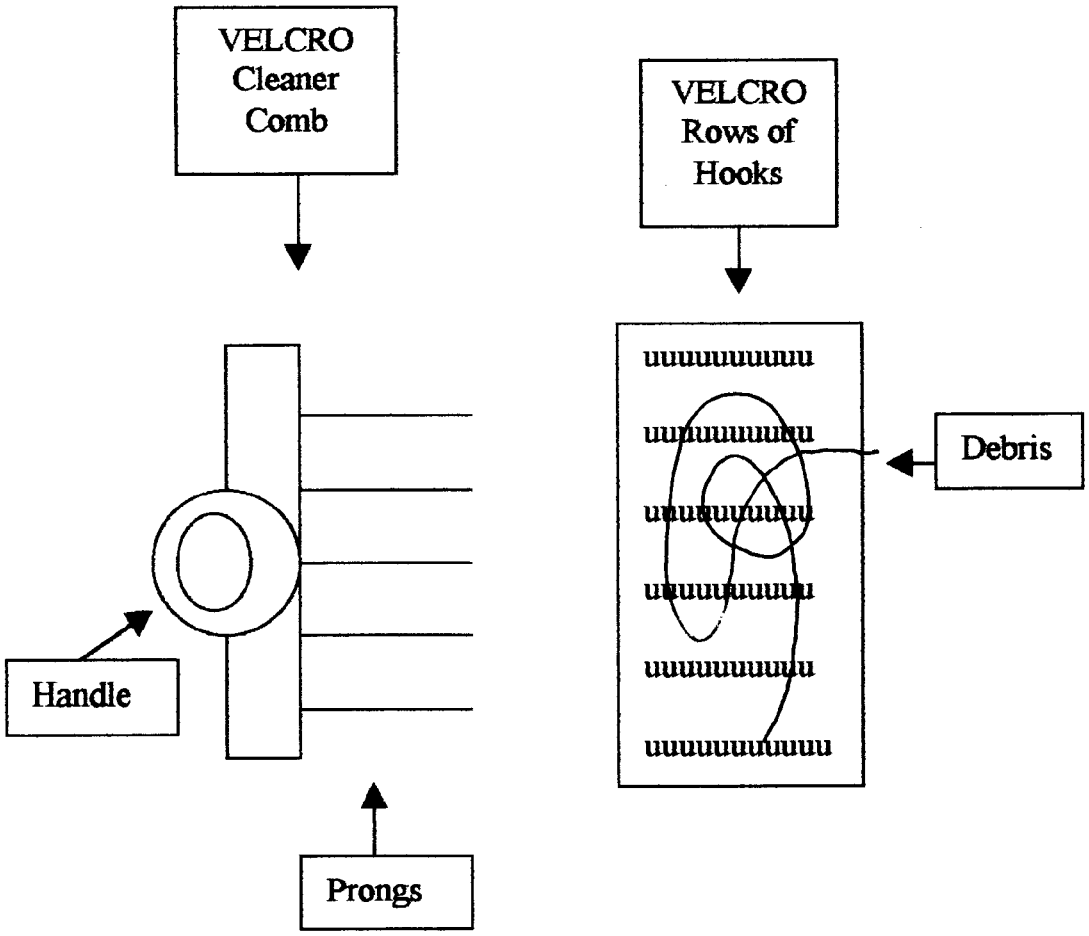

The cleaner comb was invented to fill the need for cleaning debris from VELCRO (hook/loop fastener material). VELCRO has been patented for many uses and is manufactured in many sizes. Over time VELCRO tends to accumulate debris, which is hard to remove, and reduces the VELCRO's effectiveness and appearance. The VELCRO cleaner cleans this debris by lifting it up with prongs that slide between the rows of hooks on the VELCRO. The prongs can be sized and spaced to match any type of VELCRO made.

BRIEF SUMMARY OF THE INVENTION

The cleaner comb is designed to clean VELCRO. This is accomplished by having the prongs sized and aligned to the rows of hooks on VELCRO. Debris is removed by sliding the comb prongs along the rows and under the debris and then lifting it off. This is the same concept as cleaning a hairbrush with a comb. The cleaner comb could be made in different sizes to match the many sizes of VELCRO. The comb is easiest to use if the handle is approximately perpendicular to the prongs. The comb could also be doubled sided to match two different types of VELCRO.

BRIEF DESCRIPTION OF THE VIEW OF THE DRAWING

Having thus generally described the invention, reference will be made to the accompanying drawing illustrating an embodiment thereof, in which:

FIG. 1: is a perspective view of the Cleaner Comb and a piece of VELCRO with debris on it.

Notice how the prongs are aligned between the VELCRO's rows. Moving the prongs to the right will remove the pictured debris. It will be understood that the above described embodiment is for purposes of illustration only and that changes and modifications may be made thereto without departing from the spirit and scope of the invention.

DETAILED DESCRIPTION

The Cleaner Comb consists of a one or two-sided comb, similar to a human hair comb; with each side of its prongs sized and spaced to fit between the rows of hooks of particular sizes of VELCRO. A handle, approximately perpendicular to the prongs, is used to slide the prongs between the VELCRO's rows and under debris. Examples of debris are lint, dust, hair or any material that accumulates within the rows of hooks on the VELCRO. A vertical motion with the handle causes the prongs to lift off this debris.

The Cleaner Comb can be manufactured in the same manner and materials used to make a hair comb. Examples of materials are plastic, metal or wood. The prongs should be blunt (for safety) and semi-rigid. The handle should be comfortable to grasp with the thumb and forefinger and should not be slippery. Different sizes of Cleaner Combs could be made to match the most common VELCRO sizes. Products that contain VELCRO could provide a matching Cleaner to extend the effectiveness of their product.

What is claimed is:

1. A method of cleaning a hook/loop fastener material, said fastener material including a plurality of rows of hooks, said method comprising the following steps:

a) providing a cleaning comb comprising a plurality of straight cleaner prongs spaced to correspond with the spacing between the rows of hooks, said cleaning comb further including a handle oriented substantially perpendicular to the prongs; and b) grasping the handle and sliding the cleaner prongs between and along the rows of hooks and under any debris thereon and then vertically lifting the cleaning comb with the handle to cause the cleaner prongs to lift off the debris.

* * * * *